US011455949B2

(12) United States Patent
Jiang et al.

(10) Patent No.: US 11,455,949 B2
(45) Date of Patent: Sep. 27, 2022

(54) DRIVE DEVICE FOR DISPLAY PANEL, DRIVE METHOD THEREOF AND DISPLAY APPARATUS

(71) Applicants: Chengdu BOE Optoelectronics Technology Co., Ltd., Sichuan (CN); BOE Technology Group Co., Ltd., Beijing (CN)

(72) Inventors: Yanni Jiang, Beijing (CN); Euncheol Eom, Beijing (CN); Guoqiang Wu, Beijing (CN)

(73) Assignees: CHENGDU BOE OPTOELECTRONICS TECHNOLOGY CO., LTD., Chengdu (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 59 days.

(21) Appl. No.: 16/649,374

(22) PCT Filed: Apr. 9, 2019

(86) PCT No.: PCT/CN2019/081953
§ 371 (c)(1),
(2) Date: Mar. 20, 2020

(87) PCT Pub. No.: WO2020/206615
PCT Pub. Date: Oct. 15, 2020

(65) Prior Publication Data

US 2021/0241685 A1 Aug. 5, 2021

(51) Int. Cl.
*G09G 3/3208* (2016.01)
*G05F 1/46* (2006.01)

(52) U.S. Cl.
CPC ..... *G09G 3/3208* (2013.01); *G05F 1/46* (2013.01); *G09G 2330/021* (2013.01); *G09G 2330/026* (2013.01)

(58) Field of Classification Search
CPC ..... G09G 3/3208; G09G 2330/021; G09G 2330/026; G05F 1/46
See application file for complete search history.

(56) References Cited

U.S. PATENT DOCUMENTS 9,142,191 B2 * 9/2015 Jang ..... G09G 3/3696
2013/0008291 A1 4/2013 Lee
(Continued)

FOREIGN PATENT DOCUMENTS

CN 103035174 A 4/2013
CN 105679230 A 6/2016
(Continued)

OTHER PUBLICATIONS

International search report of PCT application No. PCT/CN2019/081953 dated Dec. 27, 2019.

*Primary Examiner* — Patrick N Edouard
*Assistant Examiner* — Eboni N Giles
(74) *Attorney, Agent, or Firm* — Fay Sharpe LLP

(57) ABSTRACT

A drive device for a display panel, a drive method thereof and a display apparatus. The drive device for the display panel includes: a power management circuit and an internal driver circuit; wherein the power management circuit is configured to provide a first power supply voltage to a digital power supply terminal, the internal driver circuit is configured to convert a second power supply voltage provided by a power supply terminal into a third power supply voltage and provide the third power supply voltage to the digital
(Continued)

power supply terminal, and the digital power supply terminal is configured to provide a drive voltage to the display panel.

16 Claims, 9 Drawing Sheets

(56) References Cited

U.S. PATENT DOCUMENTS

| | | | | |
|---|---|---|---|---|
| 2014/0146429 | A1* | 5/2014 | Lee | H02H 3/243 361/86 |
| 2016/0189608 | A1* | 6/2016 | Park | G09G 3/3225 345/82 |
| 2018/0174542 | A1 | 6/2018 | Zheng et al. | |
| 2018/0275704 | A1* | 9/2018 | Li | G05F 1/573 |
| 2018/0308425 | A1 | 10/2018 | Zhou et al. | |
| 2020/0285260 | A1* | 9/2020 | Londak | G05F 1/575 |
| 2021/0135473 | A1* | 5/2021 | Wigney | H02J 7/0031 |

FOREIGN PATENT DOCUMENTS

| | | | |
|---|---|---|---|
| CN | 105741785 | A | 7/2016 |
| CN | 107038996 | A | 8/2017 |
| CN | 109448621 | A | 3/2019 |
| KR | 20180036138 | A | 4/2018 |

* cited by examiner

DRIVE DEVICE FOR DISPLAY PANEL, DRIVE METHOD THEREOF AND DISPLAY APPARATUS

This application is a 371 of International Application No. PCT/CN2019/081953, filed Apr. 9, 2019, the contents of which are incorporated herein by reference in their entirety.

TECHNICAL FIELD

The present disclosure relates to the field of display, and more particularly to a drive device for a display panel, a drive method thereof and a display apparatus.

BACKGROUND

In general, a display apparatus includes a display panel and a display driver integrated circuit (DDIC). The DDIC is configured to provide a drive voltage to the display panel in order to drive the display panel to display images.

In the related art, the DDIC may include an internal driver circuit and a digital circuit. The internal driver circuit may supply a digital voltage to the digital circuit under the drive of a power supply terminal, and the digital circuit may supply the drive voltage to the display panel under the drive of the digital voltage.

SUMMARY

The present disclosure provides a drive device for a display panel, a drive method thereof and a display apparatus. The technical solutions are as follows.

In an aspect, a drive device for a display panel is provided. The drive device includes:

a power management circuit, configured to provide a power supply voltage to a digital power supply terminal; and an internal driver circuit, configured to convert a second power supply voltage provided by a power supply terminal into a third power supply voltage and provide the third power supply voltage to the digital supply power terminal, wherein the digital power supply terminal is configured to provide a drive voltage to the display panel.

Optionally, the power management circuit is configured to provide a first power supply voltage to the digital power supply terminal continuously;

the internal driver circuit is configured to convert the second power supply voltage provided by the power supply terminal into the third power supply voltage and provide the third power supply voltage to the digital power supply terminal when a voltage of the digital power supply terminal is lower than a reference voltage, and stop providing a power supply voltage when the voltage of the digital power supply terminal is not lower than the reference voltage, wherein the reference voltage is lower than a rated operating voltage of the digital power supply terminal.

Optionally, the internal driver circuit is further configured to detect whether the voltage of the digital power supply terminal is lower than the reference voltage.

Optionally, the internal driver circuit is configured to detect whether the voltage of the digital power supply terminal is lower than the reference voltage after receiving a first enable instruction.

Optionally, a difference value between the rated operating voltage and the reference voltage is less than or equal to 0.05 volts.

Optionally, the power management circuit is configured to provide the first power supply voltage to the digital power supply terminal after receiving a second enable instruction.

Optionally, the internal driver circuit is further connected to the power management circuit; and the internal driver circuit is further configured to send a second enable instruction to the power management circuit.

Optionally, the internal driver circuit is configured to send the second enable instruction to the power management circuit after being powered on. Alternatively, the internal driver circuit is configured to send the second enable instruction to the power management circuit after receiving a first enable instruction.

Optionally, the internal driver circuit comprises: a low dropout regulator;

wherein an input terminal of the low dropout regulator is connected to the power supply terminal, an output terminal and a feedback signal terminal of the low dropout regulator are connected to the digital power supply terminal, and a reference signal terminal of the low dropout regulator is connected to a reference power supply terminal which is configured to provide the reference voltage.

Optionally, the drive device further includes: a digital circuit;

wherein the digital circuit is connected to the digital power supply terminal, and is configured to provide a drive voltage to the display panel under the drive of the digital power supply terminal.

Optionally, the drive device further includes: a flexible circuit board;

wherein the power management circuit is disposed on a printed circuit board, the internal driver circuit is disposed on a chip on film, and the flexible circuit board is connected to the printed circuit board and the chip on film.

In another aspect, a drive method for a drive device is provided. The method includes:

providing, by a power management circuit, a first power supply voltage to a digital power supply terminal; and converting, by an internal driver circuit, a second power supply voltage provided by a power supply terminal into a third power supply voltage and providing the third power supply voltage to the digital power supply terminal; wherein the digital power supply terminal is configured to provide a drive voltage to a display panel.

Optionally, providing, by the power management circuit, the first power supply voltage to the digital power supply terminal includes: providing the first power supply voltage to the digital power supply terminal by a power management circuit continuously;

converting, by the internal driver circuit, the second power supply voltage provided by the power supply terminal into the third power supply voltage and providing the third power supply voltage to the digital power supply terminal includes:

converting, by the internal driver circuit, the second power supply voltage provided by the power supply terminal into the third power supply voltage and providing the third power supply voltage to the digital power supply terminal, when a voltage of the digital power supply terminal is lower than a reference voltage; and the method further includes: controlling the internal driver circuit to stop providing a power supply voltage when the voltage of the digital power supply terminal is lower than the reference voltage.

Optionally, prior to converting, by the internal driver circuit, the second power supply voltage provided by the power supply terminal into the third power supply voltage and providing the third power supply voltage to the digital power supply terminal, the method further includes:

detecting whether the voltage of the digital power supply terminal is lower than the reference voltage after receiving a first enable instruction.

Optionally, providing, by the power management circuit, the first power supply voltage to the digital power supply terminal includes:

sending, by the internal driver circuit, a second enable instruction to the power management circuit to drive the power management circuit to provide the first power supply voltage to the digital power supply terminal.

Optionally, sending, by the internal driver circuit, the second enable instruction to the power management circuit includes:

sending, by the internal driver circuit, the second enable instruction to the power management circuit after the internal driver circuit is powered on;

or, sending the second enable instruction to the power management circuit after receiving a first enable instruction.

In yet another aspect, a display apparatus is provided. The display apparatus includes a display panel, and the drive device connected to the display panel as described in the above aspects.

Optionally, the display panel is an organic light-emitting diode display panel.

In yet another aspect, a computer-readable storage medium, having stored thereon an instruction, wherein when the computer-readable storage medium runs on a computer, the computer is enabled to execute the drive method in the above aspects.

BRIEF DESCRIPTION OF THE DRAWINGS

In order to describe the technical solutions in the embodiments of the present disclosure more clearly, the following briefly introduces the accompanying drawings required for describing the embodiments. Apparently, the accompanying drawings in the following description show merely some embodiments of the present disclosure, and a person of ordinary skill in the art may also derive other drawings from these accompanying drawings without creative efforts.

DETAILED DESCRIPTION

Embodiments of the present disclosure will be described in further detail with reference to the accompanying drawings, to present the objects, technical solutions, and advantages of the present disclosure more clearly.

Figure 1:
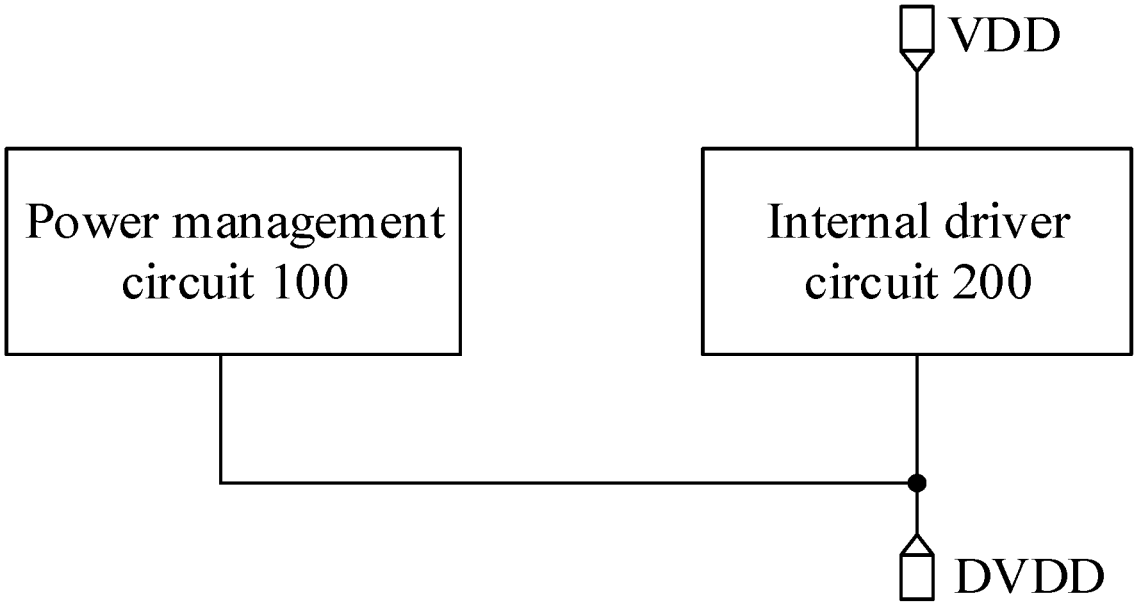
FIG. 1 is a schematic structural diagram of a drive device for a display panel according to an embodiment of the present disclosure.

FIG. 1 is a schematic structural diagram of a drive device for a display panel according to an embodiment of the present disclosure. Referring to FIG. 1, the drive device may include: a power management circuit 100 and an internal driver circuit 200.

The power management circuit 100 is configured to provide a first power supply voltage to a digital power supply terminal DVDD.

The internal driver circuit 200 is configured to convert a second power supply voltage provided by a power supply terminal VDD into a third power supply voltage, and provide the third power supply voltage to the digital power supply terminal DVDD.

The power management circuit 100 may be connected to the digital power supply terminal DVDD, and the internal driver circuit 200 may be connected to the digital power supply terminal DVDD and the power supply terminal VDD. For example, the digital power supply terminal DVDD may be connected to respective signal lines on the display panel through a digital circuit in a display driver circuit (for example, the DDIC). The digital power supply terminal DVDD can provide a digital voltage (also referred to as a logic level) to the digital circuit, to drive the digital circuit to provide the display panel with a drive voltage such as a gate high-level voltage NIGH and a gate low-level voltage VGL, thereby driving the display panel to emit light.

An embodiment of the present disclosure provides a drive device, in which both a power management circuit and an internal driver circuit may provide a power supply voltage to a digital power supply terminal, that is, both may supply power to the digital power supply terminal. Therefore, the drive device may implement the coordinated power supply of the power management circuit and internal driver circuit, which improves the driving flexibility effectively.

Exemplarily, the drive device provided in the embodiment of the present disclosure may implement multiple ways of power supply, such as separate power supply from the power management circuit 100, separate power supply from the internal driver circuit 200, simultaneous power supply from the power management circuit 100 and the internal driver circuit 200. The embodiment of the present disclosure is illustrated with the following two ways of power supply by way of example.

In the first way of power supply, the power management circuit 100 supplies power separately.

In this way of power supply, the internal driver circuit 200 stops outputting the power supply voltage, that is, the internal driver circuit 200 is in a non-working state, and only the power management circuit 100 provides the first power supply voltage to the digital power supply terminal DVDD.

Since the second power supply voltage provided by the power supply terminal VDD to the internal driver circuit 200 is generally greater than the rated operating voltage of the digital power supply terminal DVDD, the internal driver circuit 200 needs to lower the second power supply voltage and then provide the digital power supply terminal DVDD with the third power supply voltage, which may be equal to the rated operating voltage. Therefore, power consumption is relatively high when the internal driver circuit 200 supplies power. However, the power management circuit 100 may directly provide the digital power supply terminal DVDD with the first power supply voltage, which is also equal to the rated operating voltage. Therefore, the power consumption is relatively low when the power management circuit 100 supplies power.

As can be known from the analysis above, compared with the related art in which the internal driver circuit 200 supplies power separately, the power consumption during driving the display panel can be effectively reduced when the power management circuit 100 supplies power separately.

In the second way of power supply, the power management circuit 100 and the internal driver circuit 200 supply power simultaneously.

In this way of power supply, the power management circuit 100 provides the first power supply voltage to the digital power supply terminal DVDD, and meanwhile, the internal driver circuit 200 provides the third power supply voltage to the digital power supply terminal DVDD under the drive of the second power supply voltage provided by the power supply terminal VDD.

When the power management circuit 100 and the internal driver circuit 200 supply power simultaneously, the power management circuit 200, which has a strong power supply capability, i.e. a strong current supply capability, may effectively share the power supply pressure of the internal driver circuit 200, so that the internal driver circuit 200 outputs a small current and the power management circuit 100 outputs a large current. Therefore, compared with the power supply from the internal driver circuit 200 merely, the driving power consumption is also lower when the power management circuit 100 and the internal driver circuit 200 supply the power simultaneously.

It should be noted that, in addition to the above-described ways of power supply, the power management circuit 100 and the internal driver circuit 200 may also alternatively supply power to the digital power supply terminal DVDD. Alternatively, one of the power management circuit 100 and the internal driver circuit 200 may continuously supply power to the digital power supply terminal DVDD, and the other one may supply power to the digital power supply terminal DVDD for a while at regular intervals. Compared with the related art where power is supplied continuously by the internal driver circuit 200, the driving power consumption of the display panel can also be reduced since the power supply duration of the internal driver circuit 200 can be shortened or the power supply pressure of the internal driver circuit 200 can be shared. The power supply duration of each circuit may be configured before the drive device leaves the factory, or may be set by the user autonomously.

Optionally, due to relatively low power consumption, the power management circuit 100 may be configured to continuously provide the first power supply voltage to the digital power supply terminal DVDD. That is, after the power management circuit 100 is powered on, the power management circuit 100 may continuously supply power to the digital power supply terminal DVDD until it is powered off.

The internal driver circuit may be configured to: detect whether the voltage of the digital power supply terminal DVDD is lower than the reference voltage, and when the voltage of the digital power supply terminal DVDD is lower than the reference voltage, convert the second power supply voltage provided by the power supply terminal VDD into the third power supply voltage, and then provide the third power supply voltage to the digital power supply terminal DVDD, or when the voltage of the digital power supply terminal DVDD is not lower than the reference voltage, stop providing the power supply voltage.

That is, when the voltage of the digital power supply terminal DVDD is lower than the reference voltage, the power management circuit 100 and the internal driver circuit 200 may jointly supply power to the digital power supply terminal DVDD. When the voltage of the digital power supply terminal DVDD is not lower than the reference voltage, the power management circuit 100 may separately supply power to the digital power supply terminal DVDD.

The reference voltage may be lower than the rated operating voltage of the digital power supply terminal DVDD. The value of the reference voltage may be pre-configured in the drive device. For example, the value of the reference voltage may be configured before the drive device leaves the factory, that is, the value of the reference voltage may be a fixed value. Alternatively, the value of the reference voltage may be manually configured before the drive device works, that is, the value of the reference voltage is adjustable. For example, the internal driver circuit 200 may receive a reference voltage configuration instruction, and may configure the value of the reference voltage based on the voltage value carried in the reference voltage configuration instruction.

Exemplarily, a difference value between the rated operating voltage and the reference voltage may be less than or equal to 0.05 volts (V). The difference value between the rated operating voltage and the reference voltage may refer to a difference value obtained by subtracting the reference voltage from the rated operating voltage. For example, the rated operating voltage may be 1.2 V, and the reference voltage may be 1.15 V. Alternatively, the rated operating voltage may be 1.0 V, and the reference voltage may be 0.95 V.

In the embodiment of the present disclosure, the internal driver circuit 200 and the digital power supply terminal DVDD are generally integrated in the same circuit, that is, a line impedance between the two is small. However, the power management circuit 100 and the internal driver circuit 200 are generally two independent circuits, that is, the power management circuit 100 and the digital power supply terminal DVDD are integrated in different circuits respectively. Therefore, the line impedance between the power management circuit 100 and the digital power supply terminal DVDD is large.

When the color of a picture displayed by the display panel is complicated, the load current of the display panel is generally large. For example, when displaying a color picture, the load current of the display panel is generally 100-200 milliamperes (mA). Here, a resistance voltage drop (IR Drop) caused by the line impedance between the power management circuit 100 and the digital power supply terminal DVDD is large. If the power management circuit 100 is used independently to supply power to the digital power supply terminal DVDD, the voltage of the digital power supply terminal DVDD is lower than or equal to the reference voltage, that is, under-voltage may occur at the digital power supply terminal DVDD, which may result in a blurred screen of the display panel, seriously affecting the display effect.

Therefore, in the embodiment of the present disclosure, when the load current of the display panel is so large that the voltage of the digital power supply terminal LADD is not greater than the reference voltage, the internal driver circuit 200 and the power management circuit 100 may supply power to the digital power supply terminal DVDD simultaneously, that is, a hybrid way of power supply may be adopted to supply power to the digital power supply terminal DVDD. Due to the strong driving capability, i.e. the strong current supplying capability, of the power management circuit 100, the majority of the load current is provided by the power management circuit 100 and the minority of the load current is provided by the internal driver circuit 200 during the hybrid power supply, that is, the current flowing through the internal driver circuit 200 is small. Therefore, the power consumption of the internal driver circuit 200 can be effectively reduced. That is, compared with the separate power supply from the internal driver circuit 200, the power consumption of the hybrid way of power supply is also lower. Moreover, the internal driver circuit 200 can assist the power management circuit 100 in supplying power to the digital power supply terminal DVDD, to ensure that the voltage of the digital power supply terminal DVDD is greater than or equal to the reference voltage. Therefore, it can also avoid the under-voltage problem of the digital power supply terminal DVDD caused by the excessive resistance voltage drop when the power management circuit 100 supplies power separately.

When the color of the picture displayed by the display panel is relatively single, the load current of the display panel is small. For example, when displaying a white picture with a grayscale of 255, the load current of the display panel is generally 50-70 mA. Here, when the power management circuit 100 provides the first power supply voltage to the digital power supply terminal DVDD, the resistance voltage drop (IR Drop) caused by the line impedance between the power management circuit 100 and the digital power supply terminal DVDD is small, and the voltage of the digital power supply terminal DVDD is greater than the reference voltage. Thus, the drive voltage provided by the digital power supply terminal DVDD to the display panel can ensure the display effect of the display panel.

Therefore, in the embodiment of the present disclosure, when the load current of the display panel is small so that the voltage of the digital power supply terminal DVDD is greater than the reference voltage, the internal driver circuit 200 may stop providing the third power supply voltage to the digital power supply terminal DVDD, that is, the internal driver circuit 200 may be in a non-working state. Here, the power management circuit 100 may separately supply power to the digital power supply terminal DVDD, so that the driving power consumption of the display panel can be effectively reduced.

Figure 2:
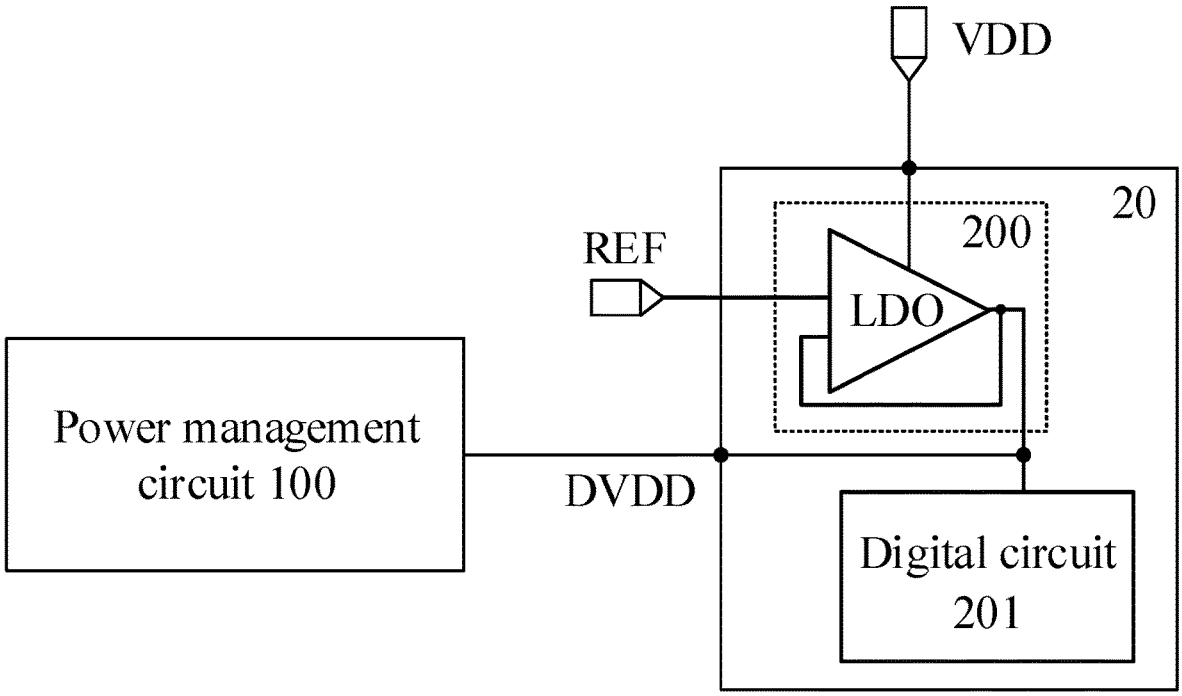
FIG. 2 is a schematic structural diagram of another drive device for a display panel according to an embodiment of the present disclosure.

As an optional implementation of this embodiment of the present disclosure, referring to FIG. 2, the internal driver circuit 200 may include: a low dropout regulator (LDO).

An input terminal of the LDO is connected to the power supply terminal VDD, an output terminal and a feedback signal terminal of the LDO are connected to the digital power supply terminal DVDD, respectively, and a reference signal terminal of the LDO may be connected to a reference power supply terminal REF which is configured to provide the reference voltage.

An error amplifier (error AMP) inside the LDO may compare the voltage $V_{DVDD}$ of the digital power supply terminal MIX) with the reference voltage $V_{REF}$ of the reference power supply terminal REF. When $V_{DVDD} \leq V_{REF}$, the LDO may be in a normal working state. The LDO may lower the second power supply voltage provided by the power supply terminal VDD, and then provide a third power supply voltage to the digital power supply terminal DVDD. When $V_{DVDD} > V_{REF}$, the LDO may be in a high-impedance state that is, the is in a non-working state and no longer supplies power to the digital power supply terminal DVDD.

Optionally, the second power supply voltage provided by the power supply terminal VDD may be 1.8 V, and the rated operating voltage of the digital power supply terminal DVDD may be 1.2 V. Then, when the LDO works normally, the second power supply voltage of 1.8 V may be lowered to the third power supply voltage of 1.2 V, which is then provided to the digital power supply terminal DVDD. The voltage difference of 0.6 V is converted, by a transistor in the MO, into thermal energy which is then consumed, and thus, the power consumption of the LDO is high. In addition, the larger the current flowing inside the LDO, the larger the power consumed by the transistor.

As can be known from the analysis above, when the internal driver circuit 200 and the power management circuit 100 conduct hybrid power supply, the current flowing the internal driver circuit 200 is small, so the power consumption of the LDO in the internal driver circuit 200 can b be effectively reduced.

Optionally, the voltage of the power supply terminal VDD may also be provided by the power management circuit 100. The power supply terminal VDD may also be referred to as an internal input/output (IO) voltage terminal of the drive device, and the second power supply voltage provided by the power supply terminal VDD may also be referred to as an internal IO voltage.

As an optional implementation, the internal driver circuit 200 may be further configured to: detect whether the voltage of the digital power supply terminal DVDD is lower than the reference voltage after receiving a first enable instruction, and then determine whether it is necessary to supply power to the digital power supply terminal DVDD according to the detection result.

The internal driver circuit 200 may also stop providing the power supply voltage before receiving the first enable instruction, or provide the third power supply voltage to the digital power supply terminal DVDD under the drive of the second power supply voltage provided by the power supply terminal VDD.

That is, before receiving the first enable instruction, the internal driver circuit 200 may continuously maintain a non-working state or a normal working state. After receiving the first enable instruction, the internal driver circuit 200 adjusts the working state thereof based on the voltage of the digital power supply terminal DVDD.

The first enable instruction may be triggered by an operator (for example, a user) through a preset operation. The preset operation may be an operation such as pressing a specified button or clicking a specified icon. The first enable instruction triggers the internal driver circuit 200 to activate its function of switching between two working states, which can effectively improve the driving flexibility.

As another optional implementation, the internal driver circuit 200 may, after being powered on, detect whether the voltage of the digital power supply terminal DVDD is lower than the reference voltage in real time, and then determine whether it is necessary to supply power to the digital power supply terminal DVDD according to the detection result.

That is, the internal driver circuit 200 may, after being powered on, automatically activate its function of switching between two working states, without the need to trigger the function with the first enable instruction.

In the embodiment of the present disclosure, the power management circuit 100 may be configured to provide the first power supply voltage to the digital power supply terminal DVDD after receiving a second enable instruction. The power management circuit 100 may not provide the first power supply voltage to the digital power supply terminal DVDD before receiving the second enable instruction.

Figure 3:
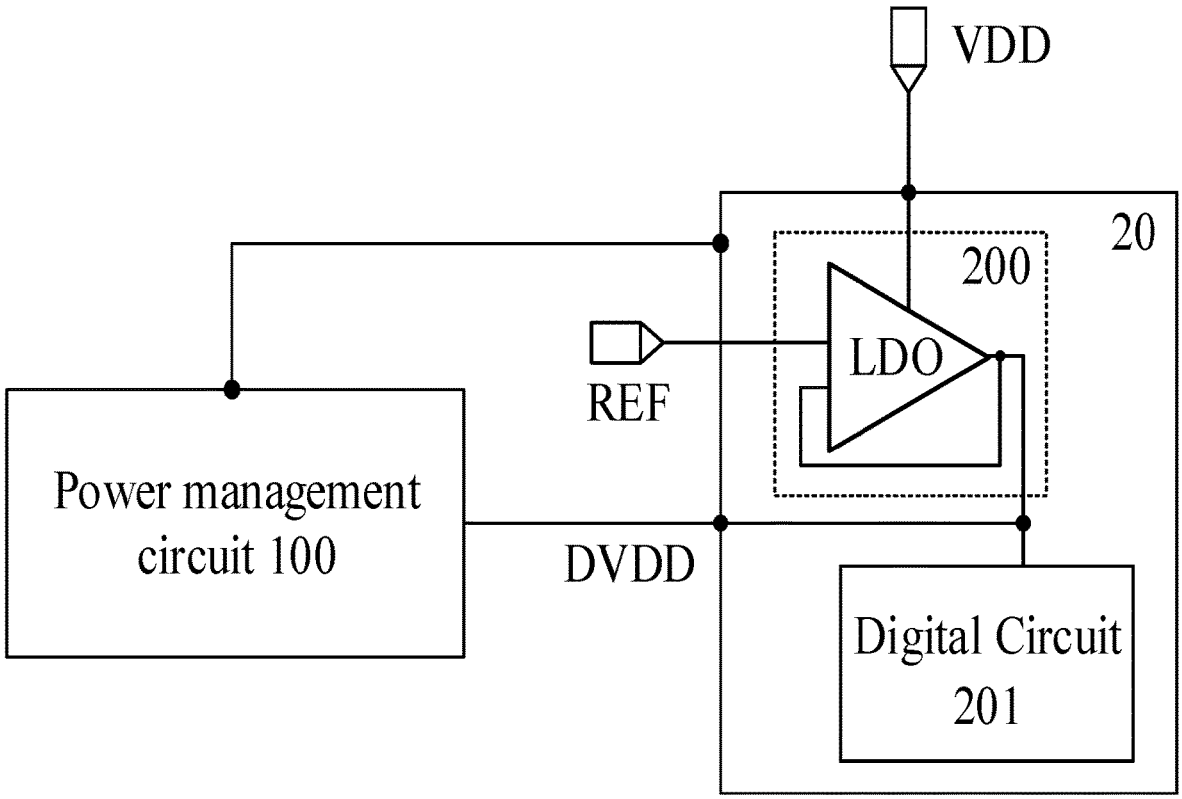
FIG. 3 is a schematic structural diagram of a further drive device for a display panel according to an embodiment of the present disclosure.

Optionally, referring to FIG. 3, the internal driver circuit 200 may also be connected to the power management circuit 100. For example, the internal driver circuit 200 may be connected to an enable pin of the power management circuit 100. The internal driver circuit 200 may also send a second enable instruction to the power management circuit 100. The power management circuit 100 may provide the first power supply voltage to the digital power supply terminal DVDD after receiving the second enable instruction. That is, the power management circuit 100 may start to supply power to the digital power supply terminal DVDD under the instruction of the internal driver circuit 200.

In the embodiment of the present disclosure, the internal driver circuit 200 may, after being powered on, send the second enable instruction to the power management circuit 100, to instruct the power management circuit 100 to work.

Alternatively, the internal driver circuit 200 may also send the second enable instruction to the power management circuit 100 after receiving the first enable instruction. That is, before the internal driver circuit 200 receives the first enable instruction, the internal driver circuit 200 may separately supply power to the digital power supply terminal DVDD.

Referring to FIG. 2 and FIG. 3, the drive device may further include: a digital circuit 201, which may be connected to the digital power supply terminal DVDD and a display panel (not shown in FIG. 2 and FIG. 3). The digital circuit 201 is configured to provide a drive voltage to the display panel under the drive of the digital power supply terminal DVDD.

Both the internal driver circuit 200 and the digital circuit 201 may be internal circuits of a display driver circuit 20. The display driver circuit 20 may be a DDIC. Correspondingly, the digital power supply terminal DVDD may be a pin on the DDIC.

Optionally, the power management circuit 100 may also be an integrated circuit, that is, the power management circuit 100 may be a power management integrated circuit (PMIC).

Figure 4:
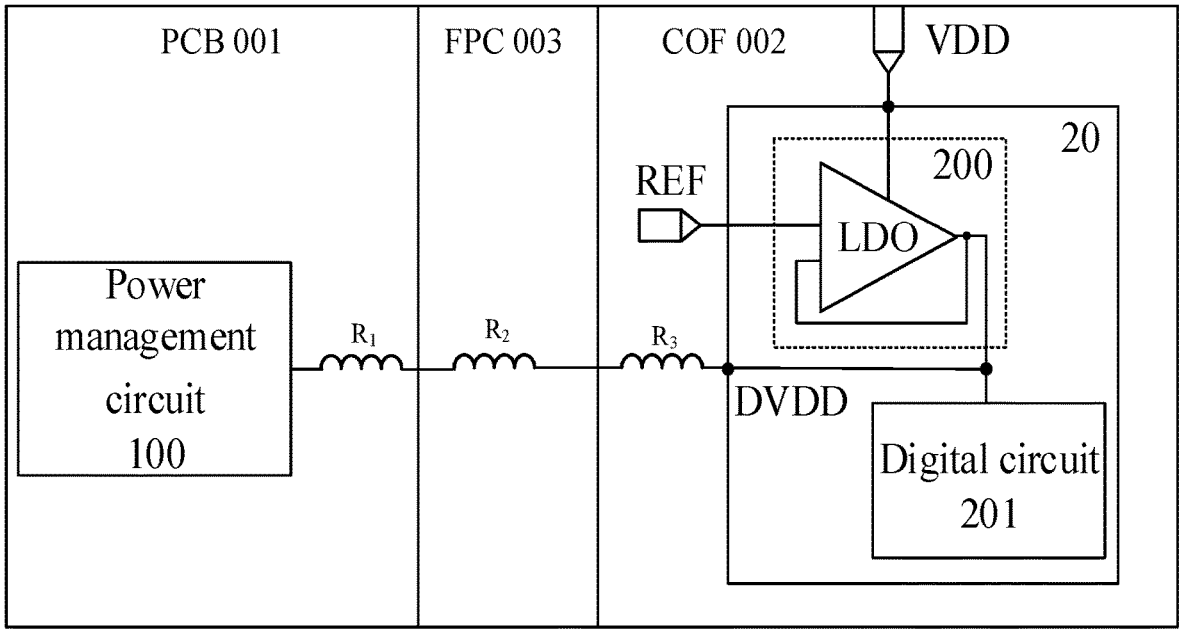
FIG. 4 is a schematic structural diagram of a further drive device for a display panel according to an embodiment of the present disclosure.

FIG. 4 is a schematic structural diagram of a further drive device according to an embodiment of the present disclosure. Referring to FIG. 4, the drive device may include: a printed circuit board (PCB) 001, a chip on film (COF) 002, and a flexible printed circuit (FPC) 003.

The power management circuit 100 is disposed on the PCB 001, and the internal driver circuit 200 is disposed on the COF 002. For example, the DDIC 20 is integrated on the COF 002. The FPC 003 is connected to the PCB 01 and the COF 002, respectively.

The PCB 001 may be a mainboard in the display apparatus, and is mainly configured to supply power (supplied by the power management circuit 100) to various devices in the display apparatus and send communication instructions. The FPC 003 may be provided with a peripheral circuit of the DDIC 20 and a memory, and the memory may be a flash memory.

Referring to FIG. 4, a line impedance $R_1$ of the PCB 001, a line impedance $R_2$ of the FPC 003, and a line impedance $R_3$ of the COF 002 are disposed between the power management circuit 100 and the digital power supply terminal DVDD. The IR Drop between the power management circuit 100 and the digital power supply terminal DVDD is large. When the load current of the display panel is large, the digital power supply terminal DVDD may undergo under-voltage. Based on measurement, if the rated operating voltage of the digital power supply terminal DVDD is 1.2 V, the display panel may have a blurred screen when the voltage of the digital power supply terminal DVDD drops below 1.15 V, which seriously affects the display effect.

Therefore, in the embodiment of the present disclosure, when the rated operating voltage of the digital power supply terminal DVDD is 1.2 V, the reference voltage may be set as 1.15 V, so that the internal driver circuit 200 may supply power to the digital power supply terminal DVDD together with the power management circuit 100 when the voltage of the digital power supply terminal DVDD is lower than 1.15 V, thereby preventing the under-voltage at the digital power supply terminal DVDD.

Figure 5:
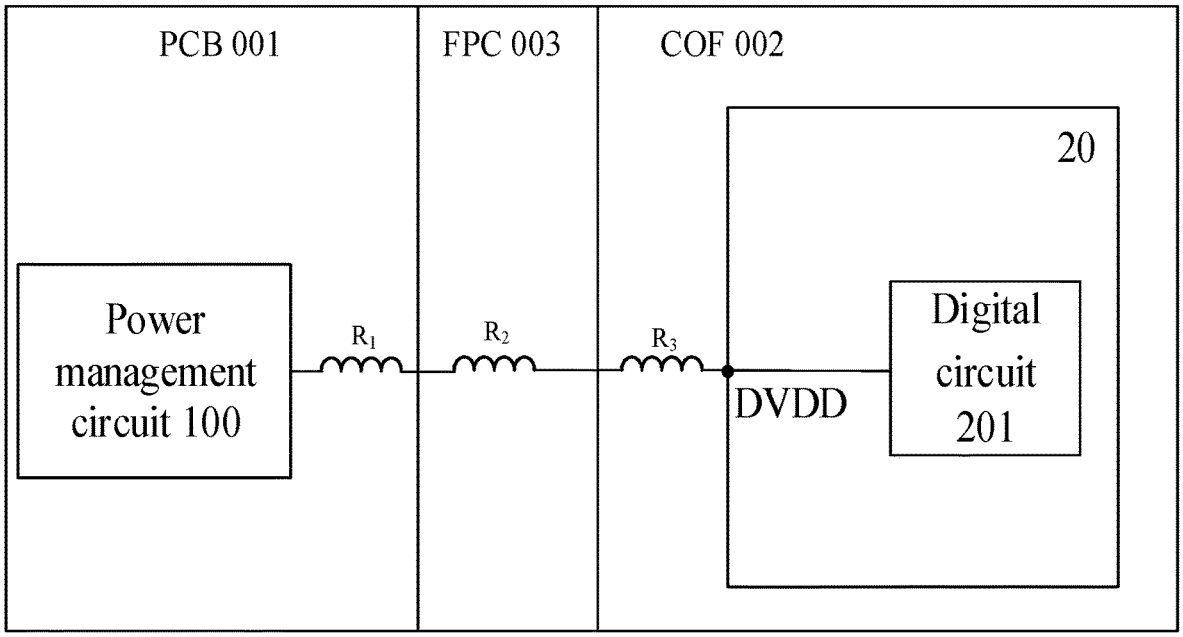
FIG. 5 is a schematic diagram of supplying power by a power management circuit separately according to an embodiment of the present disclosure.
Figure 6:
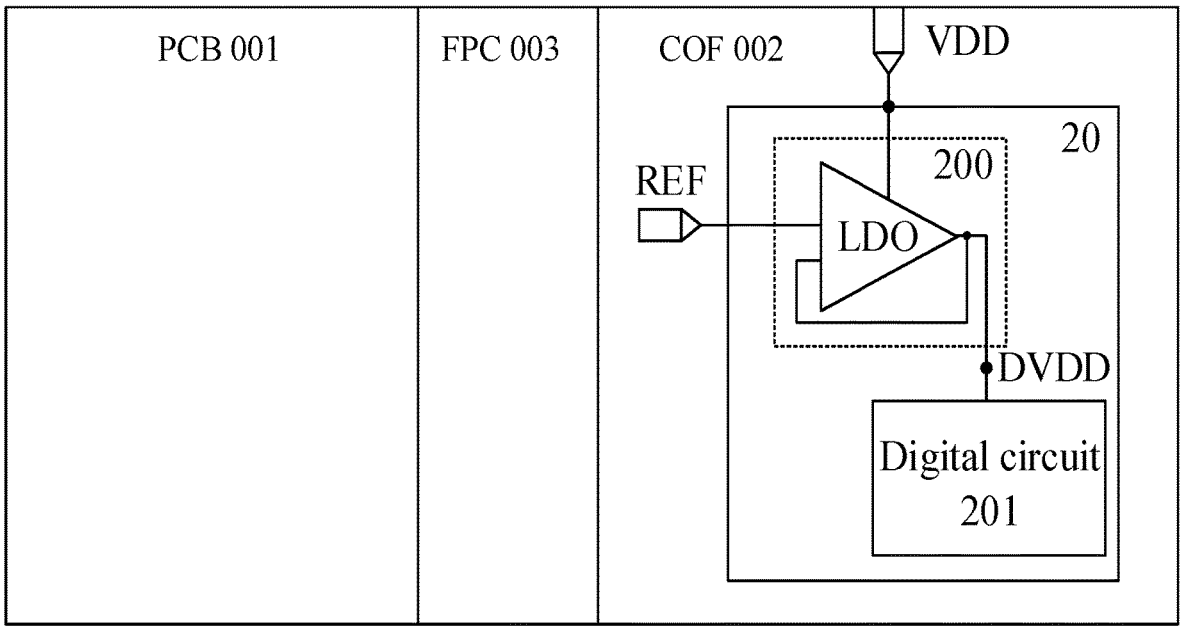
FIG. 6 is a schematic diagram of supplying power by an internal driver circuit separately, according to an embodiment of the present disclosure.

In the embodiment of the present disclosure, the driving power consumption of the display panel is tested under three different ways of power supply by taking a 6.39-inch active-matrix organic light-emitting diode (AMOLED) display panel as an example. The test results are shown in Table 1. The three ways of power supply include: the separate power supply from the power management circuit 100 as illustrated in FIG. 5, the separate power supply from the internal driver circuit 200 as illustrated in FIG. 6, and the power supply from the drive device provided in the embodiments of the present disclosure. Here, the power supply from the drive device provided in the embodiments of the present disclosure refers to that the power management circuit 100 continuously supplies power to the digital power supply terminal DVDD, and the internal driver circuit 200 supplies power to the digital power supply terminal DVDD when the voltage of the digital power supply terminal DVDD is lower than the reference voltage, and stops supplying power to the digital power supply terminal DVDD when the voltage of the digital power supply terminal DVDD is not lower than the reference voltage.

TABLE 1

| | Separate Power Supply from Power management circuit | | | Power Supply from Drive Device | | | Separate Power Supply from Internal Driver Circuit | | |
|---|---|---|---|---|---|---|---|---|---|
| | $I_1$(mA) | $I_2$(mA) | P(mW) | $I_1$(mA) | $I_2$(mA) | P(mW) | $I_1$(mA) | $I_2$(mA) | P(mW) |
| White picture | 0.6 | 66.0 | 80.28 | 0.6 | 66.0 | 80.28 | 64.0 | 0 | 115.2 |
| Color picture | 0.6 | 107.0 | 129.48 | 9.1 | 99.0 | 135.18 | 105.0 | 0 | 189 |

Referring to Table 1, when the AMOLED display panel is driven to display a white picture (i.e., the grayscale of each pixel is 255), in the way of power supply from the power management circuit 100 separately, the second power supply voltage provided by the power supply terminal VDD is 1.8 V, the internal driver circuit 200 stops working, and the current $I_1$ output from the power supply terminal VDD is 0.6 mA. The first power supply voltage provided by the power management circuit 100 to the digital power supply terminal DVDD is 1.2 V, and the current $I_2$ output from the power management circuit 100 is 66.0 mA. In this case, the driving power consumption P of the display panel is 80.28 milliwatts (mW).

When the drive device provided in the embodiment of the present disclosure is utilized to supply power, the load current is small when the white picture is displayed, and the voltage of the digital power supply terminal DVDD is not lower than the reference voltage. Therefore, the internal driver circuit 200 stops providing the power supply voltage, the power management circuit 100 supplies power separately, and the driving power consumption P of the display panel is 80.28 mW.

When the internal driver circuit 200 is utilized to supply power separately, the second power supply voltage provided by the power supply terminal VDD is 1.8 V, and the output current $I_1$ thereof is 64.0 mA. The power management circuit 100 no longer provides the voltage to the digital power supply terminal DVDD, and the output current $I_2$ thereof is 0. In this case, the driving power consumption P of the display panel is 115.2 mW.

When the AMOLED display panel is driven to display a color picture, in the way of power supply from the power management circuit 100 separately, the second power supply voltage provided by the power supply terminal VDD is 1.8 V, and the output current $I_1$ thereof is 0.6 mA, the first power supply voltage provided by the power management circuit 100 to the digital power supply terminal DVDD is 1.2 V, and the output current $I_2$ thereof is 107.0 mA, and the driving power consumption P of the display panel is 129.48 mW.

When the drive device provided in the embodiment of the present disclosure is utilized to supply power, the load current is large when the display panel displays the color picture, and the voltage of the digital power supply terminal DVDD is lower than the reference voltage. Therefore, the hybrid power supply from the internal driver circuit 200 and the power management circuit 100 is required. Due to the strong driving capability, i.e. the strong current supplying capability, of the power management circuit 100, during the hybrid power supply, the current $I_1$ output from the internal driver circuit 200 is 9.1 mA, the current $I_2$ output from the power management circuit 100 is 99.0 mA, and the driving power consumption P of the display panel is 135.18 mW, as shown in Table 1.

With the separate power supply from the internal driver circuit 200, the second power supply voltage provided by the power supply terminal VDD is 1.8 V, and the output current thereof is 105.0 mA. The power management circuit 100 no longer provides the voltage to the digital power supply terminal DVDD, and the output current $I_2$ thereof is 0. In this case, the driving power consumption P of the display panel is 189 mW.

According to the test results shown in Table 1 above, when the display panel is driven to display the white picture, the driving power consumption when the drive device provided by the embodiments of the present disclosure is utilized to supply power is the same as the driving power consumption when the power management circuit 100 supplies power separately, but is 34.92 mW lower than the driving power consumption when the internal driver circuit 200 supplies power separately.

When the display panel displays the color picture, the driving power consumption when the drive device provided by the embodiments of the present disclosure is utilized to supply power is 5.7 mW higher than the driving power consumption when the power management circuit 100 supplies power separately, but is 53.82 mW lower than the driving power consumption when the internal driver circuit 200 supplies power separately. Moreover, compared with the solution that the power management circuit 100 supplies power separately, the hybrid power supply solution provided in the embodiments of the present disclosure can ensure the stability in the voltage of the digital power supply terminal MIDI), thereby effectively preventing the display panel from the blurred screen.

In summary, the embodiments of the present disclosure provide a novel drive device, in which both the power management circuit and the internal driver circuit can provide the power supply voltage to the digital power supply terminal, that is, both can supply power to the digital power supply terminal. Therefore, the drive device may implement the coordinated power supply of the power management circuit and internal driver circuit, which improves the driving flexibility effectively.

When the internal driver circuit in the drive device stops working and the power management circuit supplies power separately, the driving power consumption of the display panel can be effectively reduced as compared with the related art where the internal driver circuit supplies power separately. When the power management circuit and the internal driver circuit in the drive device supply power simultaneously, as the power management circuit has a strong power supply capability, i.e. a strong current supply capability, the power supply pressure of the internal driver circuit can be effectively shared, so that the internal driver circuit outputs a small current and the power management circuit outputs a large current. Therefore, compared with the separate power supply from the internal driver circuit, the power consumption is also lower when the power management circuit and the internal driver circuit supply the power simultaneously. Moreover, when the power management circuit and the internal driver circuit supply power simultaneously, the under-voltage of the digital power supply terminal can also be prevented, which can further effectively prevent the display panel from the blurred screen.

Figure 7:
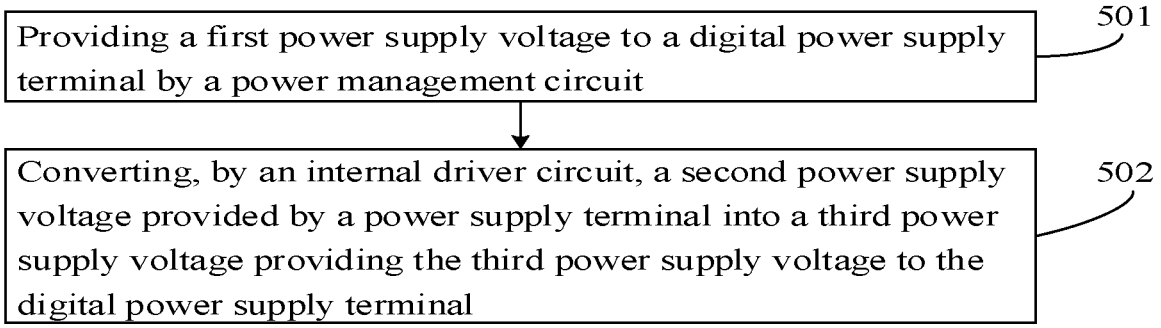
FIG. 7 is a flowchart of a drive method of a drive device according to an embodiment of the present disclosure.

FIG. 7 is a flowchart of a drive method of a drive device according to an embodiment of the present disclosure. The drive method may be applied to the drive device provided in the embodiments above, for example, the drive device as illustrated in any one of FIG. 1 to FIG. 4. Referring to FIG. 7, the method may include the following steps.

In step 501, a first power supply voltage is provided to a digital power supply terminal by a power management circuit.

The digital power supply terminal is configured to provide a drive voltage to the display panel.

In step 502, a second power supply voltage provided by a power supply terminal is converted by an internal driver circuit into a third power supply voltage and the third power supply voltage is provided to the digital power supply terminal.

With the drive method for the drive device provided in the embodiments of the present disclosure, a first power supply voltage can be provided to a digital power supply terminal by a power management circuit, and a third power supply voltage can be provided to the digital power supply terminal by an internal driver circuit. Since the power management circuit and internal driver circuit can supply power in coordination, the driving flexibility is effectively improved.

Figure 8:
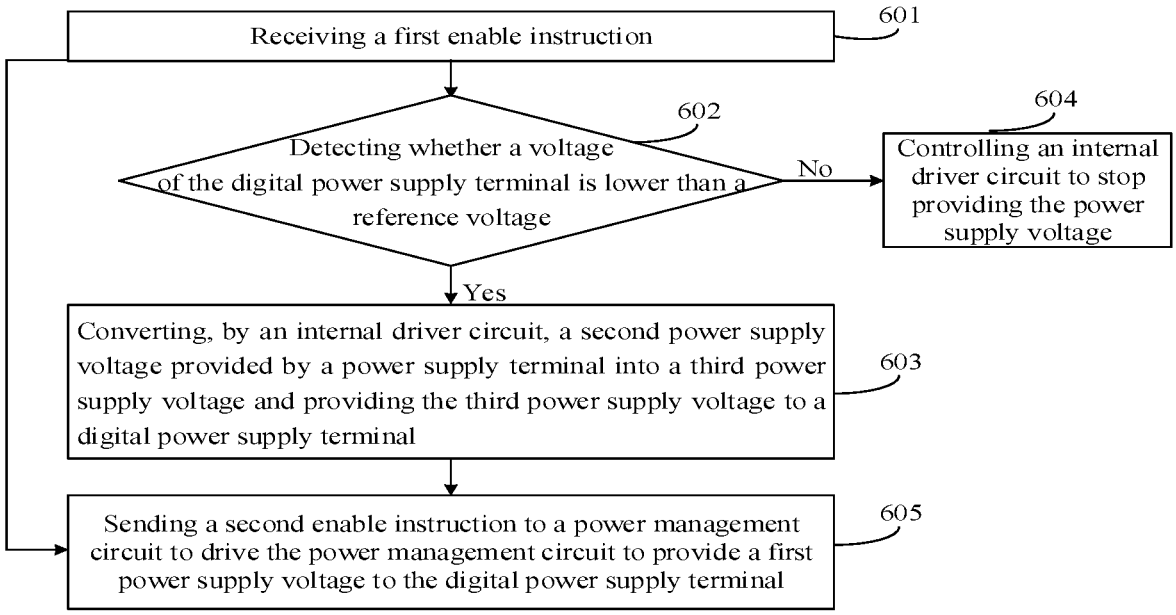
FIG. 8 is a flowchart of another drive method of a drive device according to an embodiment of the present disclosure.

FIG. 8 is a flowchart of a drive method of a drive device according to an embodiment of the present disclosure. The drive method may be applied to the drive device provided in the embodiments above, for example, the drive device as illustrated in any one of FIG. 1 to FIG. 4. Referring to FIG. 8, the method may include the following steps.

In step 601, a first enable instruction is received.

The first enable instruction may be triggered by an operator (for example, a user) through a preset operation. The preset operation may be an operation such as pressing a specified button or clicking a specified icon. After receiving the first enable instruction, the drive device may perform steps 602 and 605.

Exemplarily, the drive device may receive the first enable instruction through the internal driver circuit.

In step 602, whether a voltage of the digital power supply terminal is lower than a reference voltage is detected.

When the voltage of the digital power supply terminal is lower than the reference voltage, step 603 is performed; and when the voltage of the digital power supply terminal is not lower than the reference voltage, step 604 is performed. Exemplarily, the drive device may detect whether the voltage of the digital power supply terminal is lower than the reference voltage, through the internal driver circuit.

Optionally, before receiving the first enable instruction, the drive device may perform the following step 603 or step 604. That is, the internal driver circuit may be controlled to be in a normal working state, or in a non-working state.

In step 603, a second power supply voltage provided by a power supply terminal is converted by an internal driver circuit into a third power supply voltage and the third power supply voltage is provided to the digital power supply terminal.

When the voltage of the digital power supply terminal is lower than the reference voltage, it indicates that an under-voltage occurs at the digital power supply terminal. Therefore, the drive device may convert the second power supply voltage into the third power supply voltage through the internal driver circuit under the drive of the second power supply voltage provided by the power supply terminal, and then provide the third power supply voltage to the digital power supply terminal. In this way, the hybrid power supply from the internal driver circuit and the power management circuit may be implemented, to ensure that the voltage of the digital power supply terminal is greater than or equal to the reference voltage. Thus, the digital circuit can be driven normally, so that the digital circuit can normally drive the display panel and the blurred display of the display panel can be avoided.

In step 604, the internal driver circuit is controlled to stop providing the power supply voltage.

When the voltage of the digital power supply terminal is not lower than the reference voltage, it indicates that no under-voltage occurs at the digital power supply terminal, and the separate power supply from the power management circuit can also ensure a normal display effect. Therefore, the drive device can control the internal driver circuit to stop supplying the power supply voltage, and the power management circuit supplies power to the digital power supply terminal separately, in order to effectively reduce the driving power consumption of the display panel.

In step 605, a second enable instruction is sent to the power management circuit to drive the power management circuit to provide a first power supply voltage to the digital power supply terminal.

After receiving the first enable instruction, the drive device may send a second enable instruction to the power management circuit to drive the power management circuit to provide the first power supply voltage to the digital power supply terminal.

Alternatively, the drive device may also send the second enable instruction to the power management circuit after the internal driver circuit is powered on.

Exemplarily, the drive device may control the internal driver circuit to send the second enable instruction to the power management circuit.

It should be noted that, in the embodiments of the present disclosure, power-on of a component in the drive device may be that the power management circuit supplies power to the component. The provision of the power supply voltage by the circuit in the drive device to the digital power supply terminal may be that the circuit loads the power supply voltage between the digital power supply terminal and a ground terminal (for example, a VSS signal terminal). The provision of the drive voltage by the digital power supply terminal to the display panel may be that the digital power supply terminal loads the drive voltage between the display panel and the ground terminal.

It should also be noted that the order of the steps of the drive method according to the embodiments of the present disclosure may be appropriately adjusted, and the steps may be added or removed accordingly as required. For example, step 601 may be performed before step 602, or may be performed in parallel with step 602. Still alternatively, step 601 may also be removed as required, and step 605 may be directly executed after the drive device is powered on. Yet still alternatively, the step of sending the second enable instruction in step 605 may also be removed as required, that is, the power management circuit may continuously provide the first power supply voltage to the digital power supply terminal after being powered on. Any variations to the method readily available to any person skilled in the art in the technical scope disclosed by the present disclosure shall fall within the protection scope of the present disclosure. Therefore, a detailed description will not be repeated.

In summary, with the drive method for the drive device provided in the embodiments of the present disclosure, a first power supply voltage can be provided to a digital power supply terminal by a power management circuit, and a third power supply voltage can be provided to the digital power supply terminal by an internal driver circuit. Since the power management circuit and internal driver circuit can supply power in coordination, the driving flexibility is effectively improved.

When the internal driver circuit is controlled to stop working and the power management circuit supplies power separately, the driving power consumption of the display panel can be effectively reduced as compared with the related art where the internal driver circuit supplies power separately. When the power management circuit and the internal driver circuit supply power simultaneously, as the power management circuit has a strong power supply capability, i.e. a strong current supply capability, the power supply pressure of the internal driver circuit can be effectively shared, so that the internal driver circuit outputs a small current and the power management circuit outputs a large current. Therefore, compared with the separate power supply from the internal driver circuit, the driving power consumption is also lower when the power management circuit and the internal driver circuit supply the power simultaneously. Moreover, when the power management circuit and the internal driver circuit supply power simultaneously, the under-voltage of the digital power supply terminal can also be prevented, which can further prevent the display panel from the blurred screen.

Figure 9:
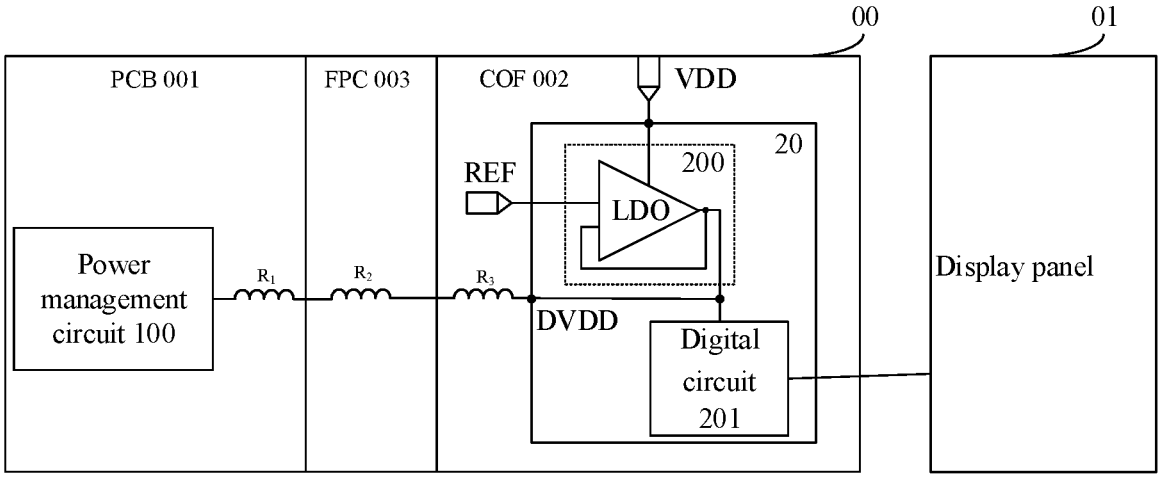
FIG. 9 is a schematic structural diagram of a display apparatus according to an embodiment of the present disclosure.

FIG. 9 is a schematic structural diagram of a display apparatus according to an embodiment of the present disclosure. Referring to FIG. 9, the display apparatus may include: a display panel 01, and a drive device 00 connected to the display panel 01. The drive device 00 may be the drive device 00 as illustrated in any one of FIGS. 1 to 4.

Optionally, the display panel 01 may be an organic light-emitting diode (PLED) display panel. For example, the display panel 01 may be an AMOLED display panel. As a self-luminous device, the AMOLED display panel has the advantages of fast response speed, low power consumption, vivid colors, and flexibility, and can be widely used in different types of display apparatuses.

Optionally, the display apparatus in the embodiments of the present disclosure may be a liquid crystal display apparatus, a piece of electronic paper, an OLED display apparatus, an AMOLED display apparatus, a mobile phone, wearable equipment (for example, a bracelet or a watch), a vehicle-mounted device, a tablet computer, a television, a displayer, a notebook computer, a digital photo frame, a navigator, or any products or components that have a display function.

According to an embodiment of the present disclosure, there is also provided a computer-readable storage medium having stored thereon an instruction. When the computer-readable storage medium runs on a computer (for example, a display apparatus), the computer is enabled to execute the drive method according to the method embodiments above.

Exemplarily, the computer-readable storage medium may be integrated in the DDIC.

Persons skilled in the art may clearly understand that for the convenience and brevity of the description, reference may be made to the corresponding description in the foregoing apparatus embodiments for the specific working process of the drive method described above, the details of which are repeated here.

The foregoing descriptions are merely exemplary embodiments of the present disclosure, and are not intended to limit the present disclosure. Within the spirit and principles of the disclosure, any modifications, equivalent substitutions, improvements, etc., are within the protection scope of the present disclosure.

What is claimed is:

1. A drive device for a display panel, comprising:

a power management circuit, configured to provide a first power supply voltage to a digital power supply terminal;

an internal driver circuit, configured to convert a second power supply voltage provided by a power supply terminal into a third power supply voltage and provide the third power supply voltage to the digital power supply terminal; and a digital circuit, connected to the digital power supply terminal, wherein the digital power supply terminal is configured to provide a digital voltage to the digital circuit, and the digital circuit is configured to provide a drive voltage to the display panel under the drive of the digital voltage; and the internal driver circuit is configured to convert the second power supply voltage provided by the power supply terminal into the third power supply voltage and provide the third power supply voltage to the digital power supply terminal when a voltage of the digital power supply terminal is lower than a reference voltage, and stop providing a power supply voltage when the voltage of the digital power supply terminal is not lower than the reference voltage; wherein the reference voltage is lower than a rated operating voltage of the digital power supply terminal, and the third power supply voltage is equal to the rated operating voltage of the digital power supply terminal.

2. The drive device according to claim 1, wherein the internal driver circuit is further configured to detect whether the voltage of the digital power supply terminal is lower than the reference voltage.

3. The drive device according to claim 2, wherein the internal driver circuit is configured to detect whether the voltage of the digital power supply terminal is lower than the reference voltage after receiving a first enable instruction.

4. The drive device according to claim 1, wherein a difference value between the rated operating voltage and the reference voltage is less than or equal to 0.05 volts.

5. The drive device according to claim 1, wherein the power management circuit is configured to provide the first power supply voltage to the digital power supply terminal after receiving a second enable instruction.

6. The drive device according to claim 1, wherein the internal driver circuit is further connected to the power management circuit; and the internal driver circuit is further configured to send a second enable instruction to the power management circuit.

7. The drive device according to claim 6, wherein the internal driver circuit is configured to send the second enable instruction to the power management circuit after being powered on.

8. The drive device according to claim 6, wherein the internal driver circuit is configured to send the second enable instruction to the power management circuit after receiving a first enable instruction.

9. The drive device according to claim 1, wherein the internal driver circuit comprises: a low dropout regulator;

wherein an input terminal of the low dropout regulator is connected to the power supply terminal, an output terminal and a feedback signal terminal of the low dropout regulator are connected to the digital power supply terminal, and a reference signal terminal of the low dropout regulator is connected to a reference power supply terminal which is configured to provide the reference voltage.

10. The drive device according to claim 1, comprising: a flexible circuit board;

wherein the power management circuit is disposed on a printed circuit board, the internal driver circuit is disposed on a chip on film, and the flexible circuit board is connected to the printed circuit board and the chip on film.

11. A drive method for a drive device, the drive device comprising a power management circuit, a digital power supply terminal, an internal driver circuit and a digital circuit which is connected to the digital power supply terminal, the method comprising:

providing, by the power management circuit, a first power supply voltage to the digital power supply terminal;

converting, by the internal driver circuit, a second power supply voltage provided by the power supply terminal into a third power supply voltage and providing the third power supply voltage to the digital power supply terminal;

providing, by the digital power supply terminal, a digital voltage to the digital circuit; and providing, by the digital circuit, a drive voltage to the display panel under the drive of the digital voltage, wherein converting, by the internal driver circuit, the second power supply voltage provided by the power supply terminal into the third power supply voltage and providing the third power supply voltage to the digital power supply terminal comprises:

converting, by the internal driver circuit, the second power supply voltage provided by the power supply terminal into the third power supply voltage and providing the third power supply voltage to the digital power supply terminal, when a voltage of the digital power supply terminal is lower than a reference voltage; and the method further comprises: controlling the internal driver circuit to stop providing a power supply voltage when the voltage of the digital power supply terminal is lower than the reference voltage;

wherein the reference voltage is lower than a rated operating voltage of the digital power supply terminal, and the third power supply voltage is equal to the rated operating voltage of the digital power supply terminal.

12. The method according to claim 11, wherein prior to converting, by the internal driver circuit, the second power supply voltage provided by the power supply terminal into the third power supply voltage and providing the third power supply voltage to the digital power supply terminal, the method further comprises:

detecting whether the voltage of the digital power supply terminal is lower than the reference voltage after receiving a first enable instruction.

13. The method according to claim 11, wherein providing, by the power management circuit, the first power supply voltage to the digital power supply terminal comprises:

sending, by the internal driver circuit, a second enable instruction to the power management circuit to drive the power management circuit to provide the first power supply voltage to the digital power supply terminal.

14. The method according to claim 13, wherein sending, by the internal driver circuit, the second enable instruction to the power management circuit comprises:

sending, by the internal driver circuit, the second enable instruction to the power management circuit after the internal driver circuit is powered on;

or, sending the second enable instruction to the power management circuit after receiving a first enable instruction.

15. A display apparatus, comprising a display panel, and a drive device connected to the display panel, the drive device comprising:

a power management circuit, configured to provide a first power supply voltage to a digital power supply terminal;

an internal driver circuit, configured to convert a second power supply voltage provided by a power supply terminal into a third power supply voltage and provide the third power supply voltage to the digital power supply terminal; and a digital circuit, which is connected to the digital power supply terminal, wherein the digital power supply terminal is configured to provide a digital voltage to the digital circuit, and the digital circuit is configured to provide a drive voltage to the display panel under the drive of the digital voltage; and the internal driver circuit is configured to convert the second power supply voltage provided by the power supply terminal into the third power supply voltage and provide the third power supply voltage to the digital power supply terminal when a voltage of the digital power supply terminal is lower than a reference voltage, and stop providing a power supply voltage when the voltage of the digital power supply terminal is not lower than the reference voltage; wherein the reference voltage is lower than a rated operating voltage of the digital power supply terminal, and the third power supply voltage is equal to the rated operating voltage of the digital power supply terminal.

16. The display apparatus according to claim 15, wherein the display panel is an organic light-emitting diode display panel.

* * * * *